US010760784B2

(12) United States Patent
Karkow et al.

(10) Patent No.: US 10,760,784 B2
(45) Date of Patent: Sep. 1, 2020

(54) BURNER INCLUDING A PERFORATED FLAME HOLDER SPACED AWAY FROM A FUEL NOZZLE

(71) Applicant: CLEARSIGN TECHNOLOGIES CORPORATION, Seattle, WA (US)

(72) Inventors: Douglas W. Karkow, Mount Vernon, IA (US); Joseph Colannino, Oceanside, CA (US); Igor A. Krichtafovitch, Kirkland, WA (US); Robert E. Breidenthal, Seattle, WA (US); Christopher A. Wiklof, Everett, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 194 days.

(21) Appl. No.: 15/823,419

(22) Filed: Nov. 27, 2017

(65) Prior Publication Data

US 2018/0080648 A1 Mar. 22, 2018

Related U.S. Application Data

(63) Continuation of application No. 14/763,271, filed as application No. PCT/US2014/016628 on Feb. 14, 2014, now Pat. No. 9,857,076.

(Continued)

(51) Int. Cl.
*F23C 5/08* (2006.01)
*F23D 14/14* (2006.01)

(Continued)

(52) U.S. Cl.
CPC ..... *F23D 14/14* (2013.01); *F23C 5/08* (2013.01); *F23C 99/001* (2013.01); *F23D 14/20* (2013.01);

(Continued)

(58) Field of Classification Search
CPC ..... F23D 14/14; F23C 5/08

(Continued)

(56) References Cited

U.S. PATENT DOCUMENTS 2,560,862 A * 7/1951 Harrison ..... F23D 14/00 239/553.5
3,076,605 A 2/1963 Holden (Continued)

FOREIGN PATENT DOCUMENTS

CN 1506609 6/2004
CN 101514815 8/2009

(Continued)

OTHER PUBLICATIONS

PCT International Search Report and Written Opinion dated May 26, 2014, for International Patent Application No. PCT/US2014/016626 filed Feb. 14, 2014.

(Continued)

*Primary Examiner* — Avinash A Savani
(74) *Attorney, Agent, or Firm* — Christopher A. Wiklof; Nicholas S. Bromer; Launchpad IP, Inc.

(57) ABSTRACT

A perforated flame holder and burner including a perforated flame holder provides reduced oxides of nitrogen (NOx) during operation. The perforated flame holder includes a pattern of elongated apertures extending between a proximal and a distal surface of the flame holder relative to a fuel nozzle. The perforated flame holder can provide a significantly reduced flame height while maintaining heat output from the burner.

44 Claims, 15 Drawing Sheets

Related U.S. Application Data

(60) Provisional application No. 61/765,022, filed on Feb. 14, 2013.

(51) Int. Cl.

| | |
|---|---|
| ***F23D 14/20*** | (2006.01) |
| ***F23D 14/74*** | (2006.01) |
| ***F23M 5/02*** | (2006.01) |
| ***F23C 99/00*** | (2006.01) |
| ***F23D 14/70*** | (2006.01) |
| ***F23D 14/84*** | (2006.01) |
| ***F23D 23/00*** | (2006.01) |

(52) U.S. Cl.
CPC ..... *F23D 14/70* (2013.01); *F23D 14/74* (2013.01); *F23D 14/84* (2013.01); *F23D 23/00* (2013.01); *F23M 5/025* (2013.01); *F23C 2200/00* (2013.01); *F23N 2237/02* (2020.01)

(58) Field of Classification Search
USPC ..... 431/328, 79
See application file for complete search history.

(56) References Cited

U.S. PATENT DOCUMENTS

| | | | | |
|---|---|---|---|---|
| 3,216,477 | A * | 11/1965 | Devine | F23M 11/045 431/79 |
| 3,228,614 | A | 1/1966 | Bauer | |
| 3,324,924 | A | 6/1967 | Hailstone et al. | |
| 3,663,154 | A | 5/1972 | Locke | |
| 3,847,534 | A * | 11/1974 | Nomaguchi | F23C 99/00 431/329 |
| 4,021,188 | A | 5/1977 | Yamagishi et al. | |
| 4,081,958 | A | 4/1978 | Schelp | |
| 4,397,356 | A | 8/1983 | Retallick | |
| 4,408,461 | A | 10/1983 | Bruhwiler et al. | |
| 4,473,349 | A | 9/1984 | Kumatsu | |
| 4,519,770 | A | 5/1985 | Kesselring et al. | |
| 4,588,373 | A | 5/1986 | Tonon et al. | |
| 4,673,349 | A | 6/1987 | Abe et al. | |
| 4,726,767 | A | 2/1988 | Nakajima | |
| 4,752,213 | A | 6/1988 | Grochowski et al. | |
| 4,850,862 | A | 7/1989 | Bjerklie | |
| 4,899,696 | A | 2/1990 | Kennedy et al. | |
| 5,248,255 | A | 9/1993 | Morioka et al. | |
| 5,275,552 | A | 1/1994 | Schwartz et al. | |
| 5,326,257 | A | 7/1994 | Taylor et al. | |
| 5,380,192 | A | 1/1995 | Hamos | |
| 5,431,557 | A | 7/1995 | Hamos | |
| 5,439,372 | A | 8/1995 | Duret et al. | |
| 5,441,402 | A | 8/1995 | Reuther et al. | |
| 5,458,484 | A | 10/1995 | Ripka | |
| 5,460,512 | A | 10/1995 | Lifshits et al. | |
| 5,511,516 | A | 4/1996 | Moore, Jr. et al. | |
| 5,641,282 | A | 6/1997 | Lee et al. | |
| 5,667,374 | A | 9/1997 | Nutcher et al. | |
| 5,713,206 | A | 2/1998 | McWhirter et al. | |
| 5,718,573 | A | 2/1998 | Knight et al. | |
| 5,846,067 | A | 12/1998 | Nishiyama et al. | |
| 5,890,886 | A | 4/1999 | Doker et al. | |
| 5,957,682 | A | 9/1999 | Kamal et al. | |
| 6,065,963 | A | 5/2000 | Dewaegheneire et al. | |
| 6,140,658 | A | 10/2000 | Jarvinen | |
| 6,159,001 | A | 12/2000 | Kushch et al. | |
| 6,499,990 | B1 | 12/2002 | Zink et al. | |
| 6,997,701 | B2 | 2/2006 | Volkert et al. | |
| 7,241,137 | B2 | 7/2007 | Leinemann et al. | |
| 2002/0155403 | A1 | 10/2002 | Griffin et al. | |
| 2004/0058290 | A1 | 3/2004 | Mauzey et al. | |
| 2004/0081933 | A1 | 4/2004 | St. Charles et al. | |
| 2004/0197719 | A1 | 10/2004 | Chung et al. | |
| 2006/0008755 | A1 | 1/2006 | Leinemann et al. | |
| 2006/0141413 | A1 | 6/2006 | Masten et al. | |
| 2008/0268387 | A1 | 10/2008 | Saito et al. | |
| 2009/0053664 | A1 | 2/2009 | Staller et al. | |
| 2010/0077731 | A1 | 4/2010 | Jeong et al. | |
| 2011/0027734 | A1 | 2/2011 | Hartwick et al. | |
| 2011/0076628 | A1 | 3/2011 | Miura et al. | |
| 2012/0164590 | A1 | 6/2012 | Mach | |
| 2012/0231398 | A1 | 9/2012 | Carpentier et al. | |
| 2015/0276212 | A1 | 10/2015 | Karkow et al. | |
| 2015/0276213 | A1 | 10/2015 | Karkow et al. | |
| 2015/0276217 | A1 | 10/2015 | Karkow et al. | |
| 2015/0276220 | A1 | 10/2015 | Karkow et al. | |
| 2015/0285491 | A1 | 10/2015 | Karkow et al. | |
| 2015/0316261 | A1 | 11/2015 | Karkow et al. | |
| 2015/0330625 | A1 | 11/2015 | Karkow et al. | |
| 2015/0369477 | A1 | 12/2015 | Karkow et al. | |

FOREIGN PATENT DOCUMENTS

| | | |
|---|---|---|
| CN | 102032569 | 4/2011 |
| CN | 102853424 | 1/2013 |
| JP | S 59112111 | 6/1984 |
| JP | 06-026624 | 2/1994 |
| JP | 07-083076 | 3/1995 |
| JP | 2006-275482 | 10/2006 |
| WO | WO 2015/042614 | 3/2015 |
| WO | WO 2015/042615 | 3/2015 |
| WO | WO 2015/054323 | 4/2015 |
| WO | WO 2015/061760 | 4/2015 |
| WO | WO 2015/112950 | 7/2015 |

OTHER PUBLICATIONS

PCT International Search Report and Written Opinion dated Jun. 3, 2014, for International Patent Application No. PCT/US2014/016632 filed Feb. 14, 2014.

PCT International Search Report and Written Opinion dated May 27, 2014, for International Patent Application No. PCT/US2014/016622 filed Feb. 14, 2014.

EPO Extended Search Report and Search Opinion of EP Application No. 14752076.1 dated Oct. 27, 2016.

PCT International Search Report and Written Opinion of International PCT Application No. PCT/US2014/016628 dated Feb. 14, 2014.

Arnold Schwarzenegger, A Low NOx Porous Ceramics Burner Performance Study, California Energy Commission Public Interest Energy Research Program, Dec. 2007, San Diego State University Foundation.

Fric, Thomas F., "Effects of Fuel-Air Unmixedness on NOx Emissions," Sep.-Oct. 1993. Journal of Propulsion and Power, vol. 9, No. 5, pp. 708-713.

* cited by examiner

BURNER INCLUDING A PERFORATED FLAME HOLDER SPACED AWAY FROM A FUEL NOZZLE

CROSS-REFERENCE TO RELATED APPLICATIONS

The present application is a U.S. Continuation application of co-pending U.S. patent application Ser. No. 14/763,271, entitled "PERFORATED FLAME HOLDER AND BURNER INCLUDING A PERFORATED FLAME HOLDER," filed Jul. 24, 2015; co-pending U.S. patent application Ser. No. 14/763,271 is a U.S. National Phase application under 35 U.S.C. 371 of International Patent Application No. PCT/US2014/016628, entitled "PERFORATED FLAME HOLDER AND BURNER INCLUDING A PERFORATED FLAME HOLDER," filed Feb. 14, 2014; which application claims the benefit of U.S. Provisional Patent Application No. 61/765,022, entitled "PERFORATED FLAME HOLDER AND BURNER INCLUDING A PERFORATED FLAME HOLDER," filed Feb. 14, 2013; each of which, to the extent not inconsistent with the disclosure herein, are incorporated by reference.

The present application is related to International Patent Application No. PCT/US2014/016626, entitled "SELECTABLE DILUTION LOW NOx BURNER," filed Feb. 14, 2014; International Patent Application No. PCT/US2014/016632, entitled "FUEL COMBUSTION SYSTEM WITH A PERFORATED REACTION HOLDER," filed Feb. 14, 2014; and International Patent Application No. PCT/US2014/016622, entitled "STARTUP METHOD AND MECHANISM FOR A BURNER HAVING A PERFORATED FLAME HOLDER," filed Feb. 14, 2014; each of which, to the extent not inconsistent with the disclosure herein, are incorporated by reference.

SUMMARY

According to an embodiment, a burner includes at least one fuel nozzle configured to output a diverging fuel stream and a perforated flame holder disposed away from the fuel nozzle(s). The perforated flame holder has a proximal side and a distal side disposed toward and away from the fuel nozzle, respectively. The perforated flame holder defines a plurality of elongated apertures extending from the proximal side of the flame holder, through the flame holder, to the distal side of the flame holder. The fuel nozzle and the perforated flame holder are arranged to provide at least partial premixing of the diverging fuel stream with a fluid containing an oxidizer, such as air or flue gas in a premixing region between the fuel nozzle and the flame holder. The flame holder is configured to support a flame in the plurality of elongated apertures and in regions immediately above the distal side of the flame holder and/or immediately below the proximal side of the flame holder.

According to an embodiment, a perforated flame holder for a combustion reaction includes a high temperature-compatible material having a distal surface and a proximal surface, and a plurality of elongated apertures formed to extend through the high temperature compatible material from the proximal surface to the distal surface. The perforated flame holder is configured to be supported in a combustion volume, aligned with a diverging fuel stream provided by at least one fuel nozzle, and separated from the at fuel nozzle by a distance selected to provide at least partial premixing of the diverging fuel stream with a surrounding gas. A flame holder support structure is configured to maintain a selected alignment between the flame holder proximal surface and the fuel nozzle.

DETAILED DESCRIPTION

Figure 1:
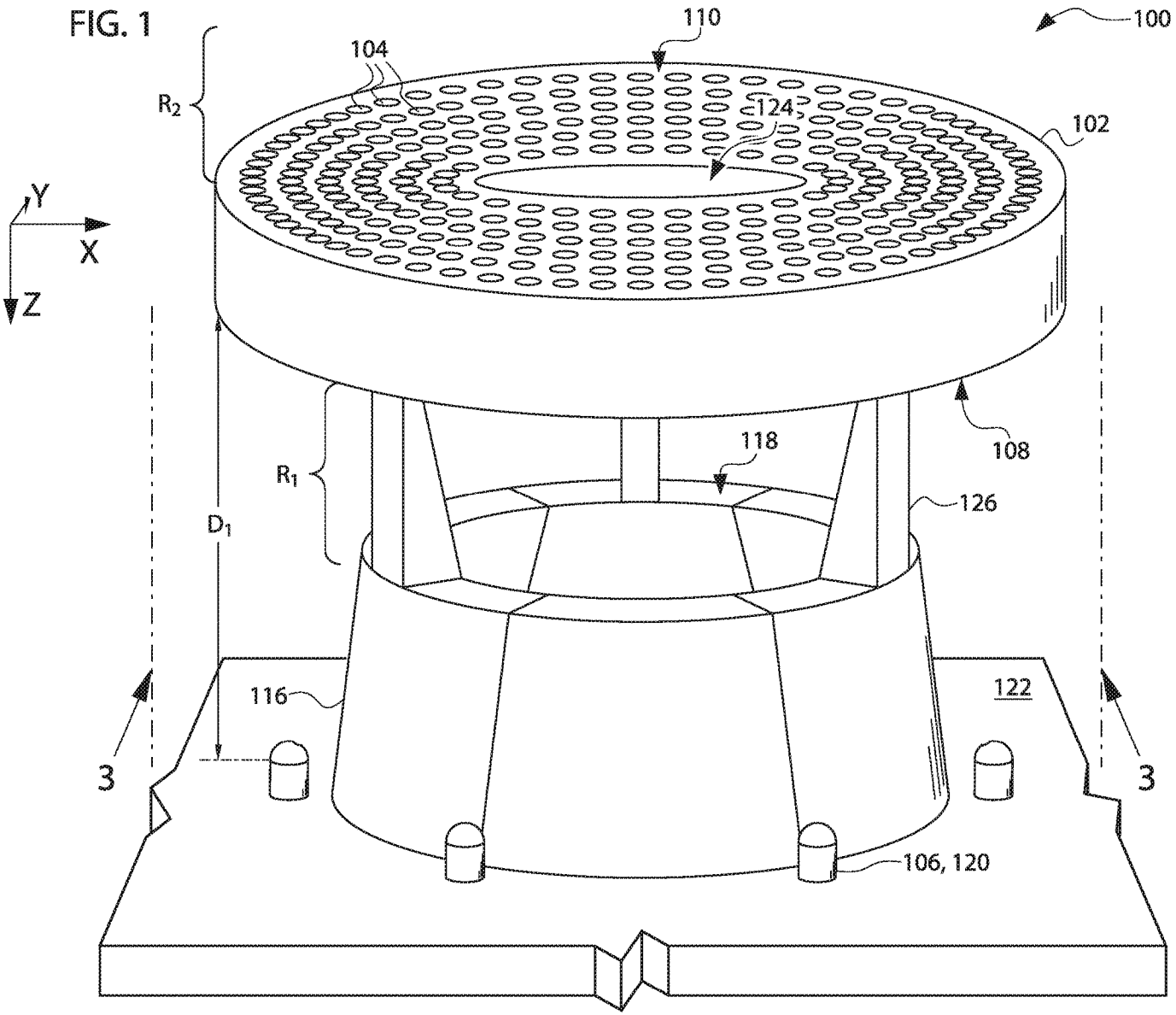
FIG. 1 is a view of a burner including a flame holder having orifices, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Figure 2:
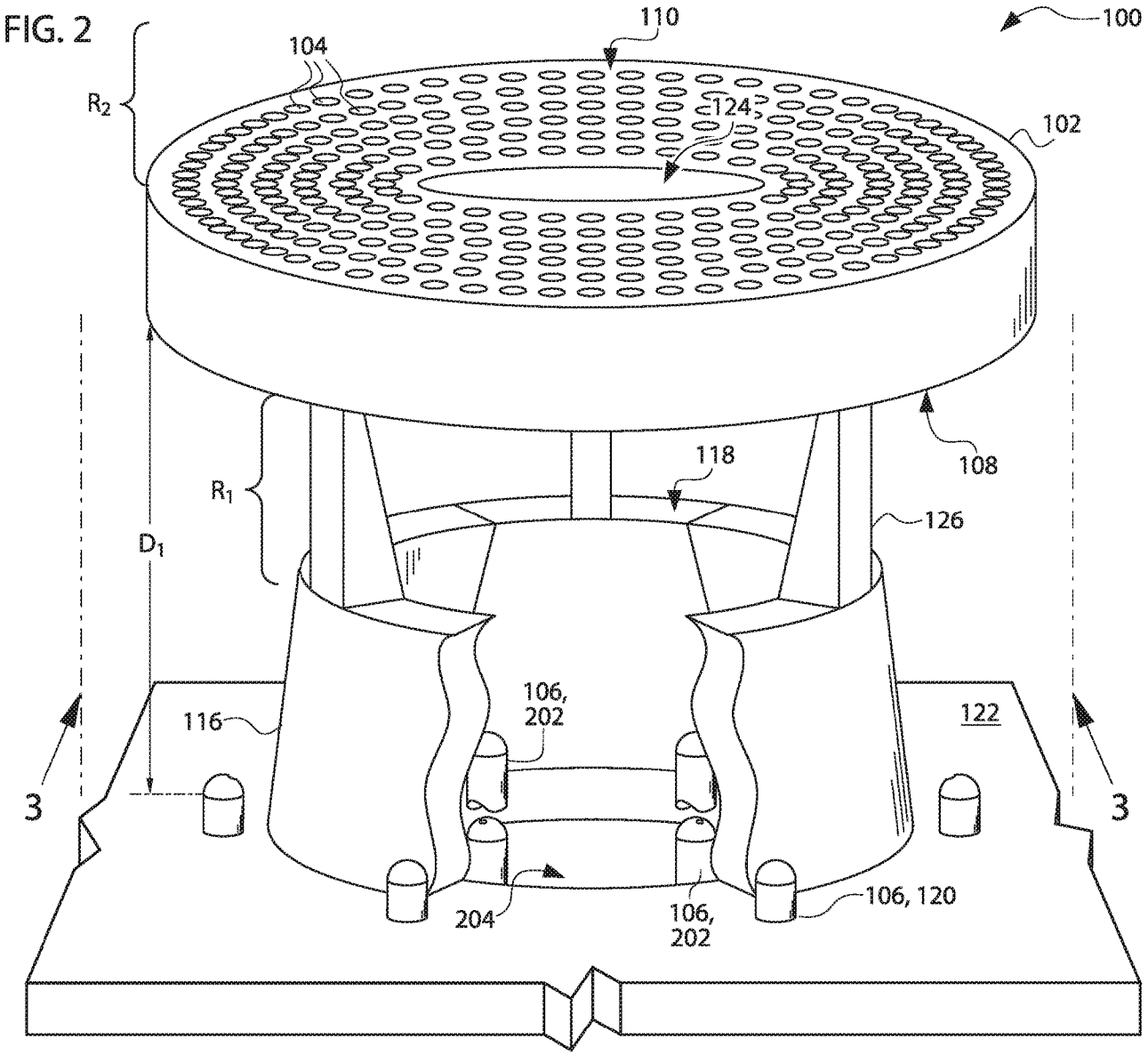
FIG. 2 is a cutaway view of the burner of FIG. 1, according to an embodiment.
Figure 3A:
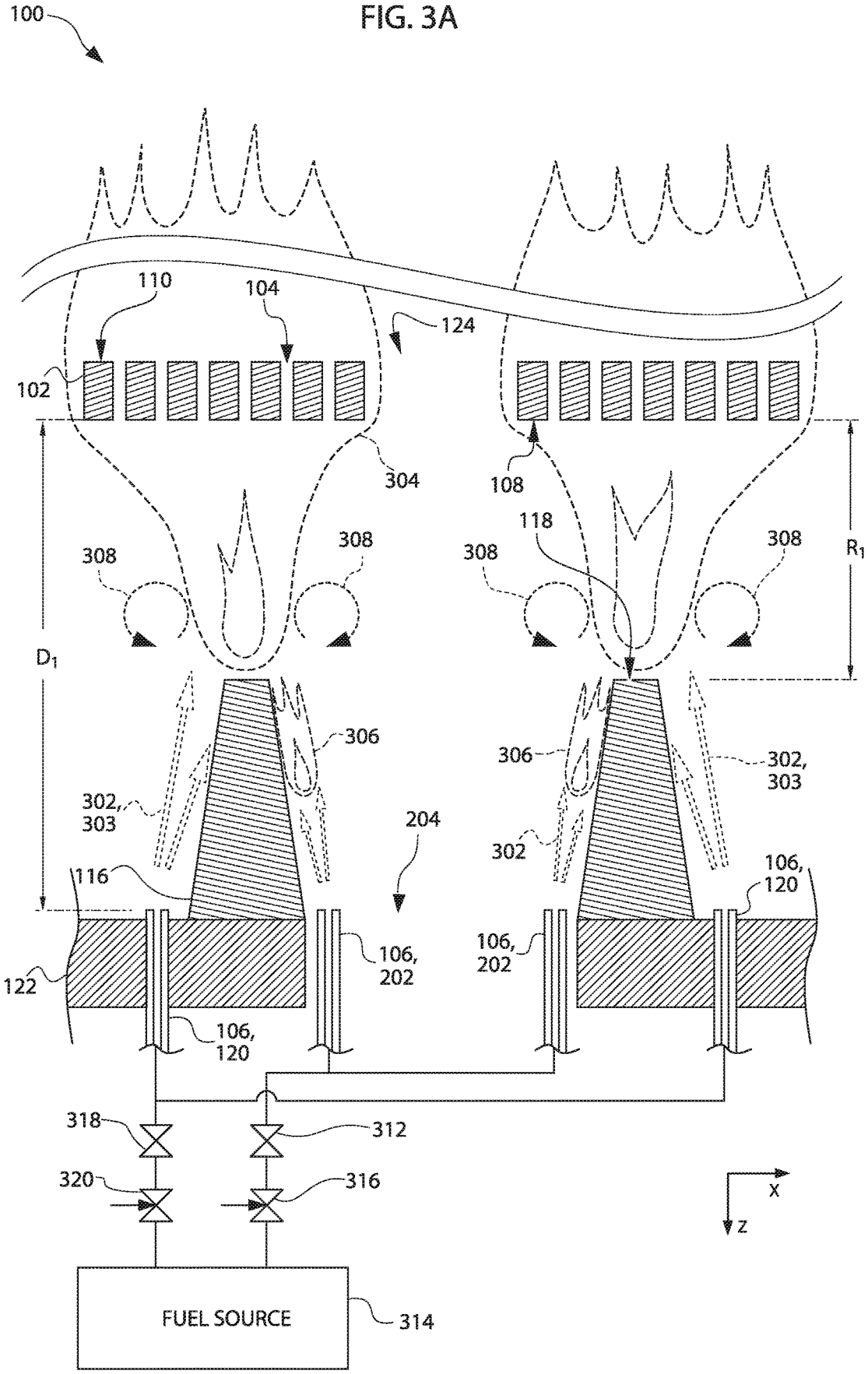
FIG. 3A is a partial side sectional view of the burner of FIGS. 1 and 2, taken along lines 3-3 of FIG. 1 during a startup phase of operation, according to an embodiment.
Figure 3B:
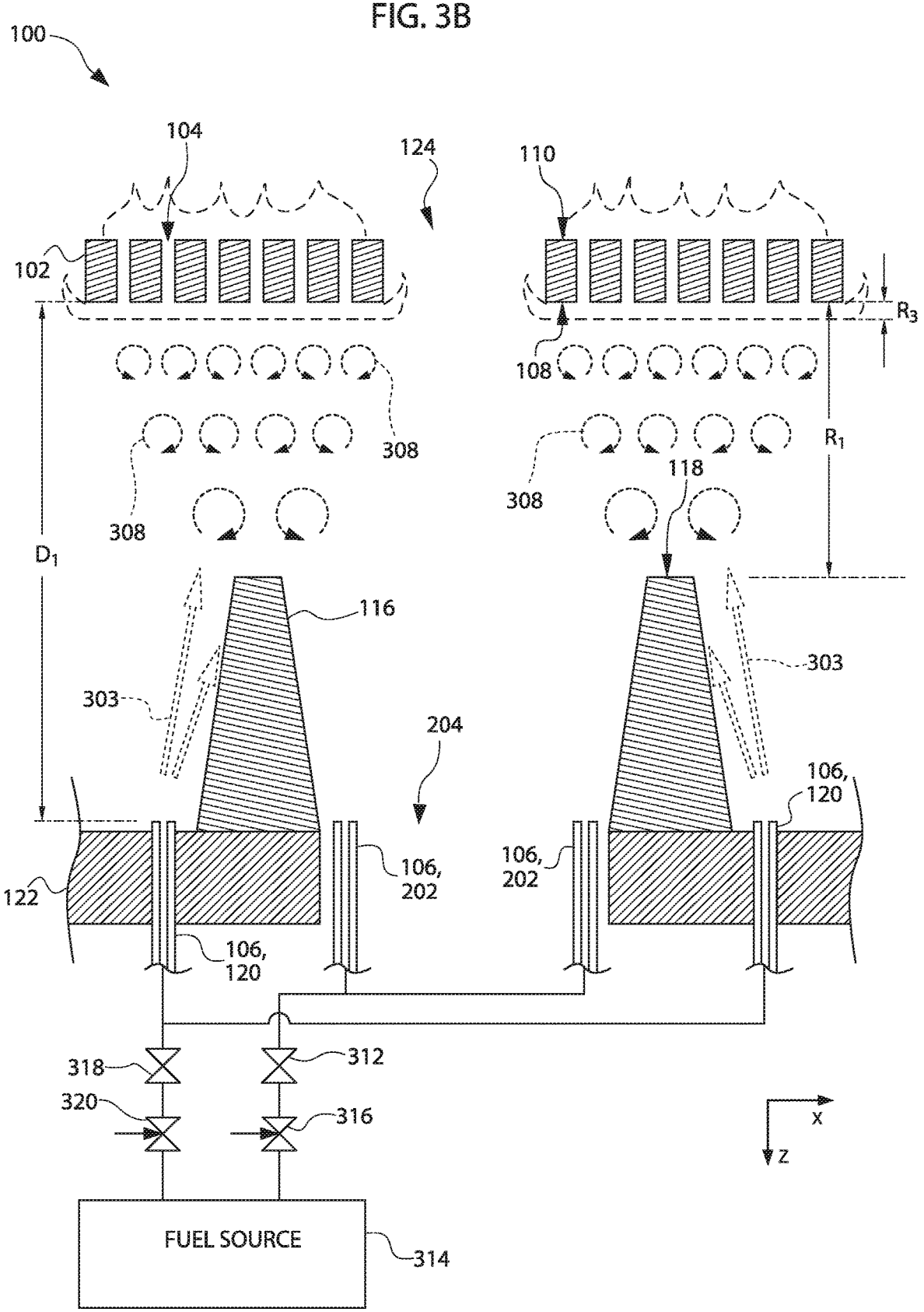
FIG. 3B shows the same view of the burner of FIG. 3A during normal operation, according to an embodiment.

FIG. 1 is a view of a burner 100 including a flame holder 102 having orifices 104, according to an embodiment. FIG. 2 is a cutaway view of the burner 100 including the flame holder 102 of FIG. 1, according to an embodiment. FIGS. 3A and 3B are partial side sectional views of the burner 100 of FIGS. 1 and 2 during respective phases of operation, according to an embodiment. Referring to FIGS. 1, 2, 3A, and 3B, the burner 100 includes at least one fuel nozzle 106, and can include a plurality of fuel nozzles 106. The fuel nozzles 106 are configured to output a diverging fuel stream 302. A flame holder 102 is disposed away from the fuel nozzles 106. In the embodiment shown, the flame holder 102 is disk-shaped, and has an X:Z aspect ratio that is greater than about 6:1. In other words, a dimension of the flame holder 102 in the X axis, i.e., its diameter, is more than about six-times its dimension in the Z axis, i.e., its thickness. According to other embodiments, the X:Z aspect ratio is greater than about 4:1.

The flame holder 102 has a proximal side 108 and a distal side 110. The proximal side 108 and the distal side 110 are disposed toward and away from the fuel nozzles 106, respectively. The flame holder 102 defines a plurality of elongated orifices or apertures 104. The plurality of elongated apertures 104 extend from the proximal side 108 of the flame holder 102, through the flame holder 102, to the distal side 110 of the flame holder 102.

In the embodiment shown, the fuel nozzles 106 and the flame holder 102 are separated a distance sufficient to provide at least partial premixing of the diverging fuel stream 302 with a fluid containing an oxidizer, such as air or flue gas, in a premixing region $R_1$ between the fuel nozzles 106 and the flame holder 102. The flame holder 102 is configured to support a flame 304 within the plurality of elongated apertures 104. Under some conditions, the flame can also extend through the distal side 110 of the flame holder 102 into a region $R_2$ above the distal side 110 of the flame holder 102. Under some conditions, the flame can also extend through the proximal side 108 of the flame holder 102 into a region $R_3$ just below the proximal side 108 of the flame holder 102.

According to an embodiment, the burner 100 includes a burner tile 116 disposed adjacent to the fuel nozzles 106 and can occupy a portion of a distance $D_1$ between the fuel nozzles 106 and the flame holder 102.

As shown in particular in FIG. 3A, the burner tile 116 defines an intermediate flame support surface 118 disposed along the diverging fuel stream 302, part way between the fuel nozzles 106 and the proximal surface 108 of the flame holder 102, and can be configured to support a secondary flame 304 during at least one of start-up, low fuel flow, or ignition by a primary flame 306. The burner tile 116 can thus define an intermediate flame support surface 118 part way between the fuel nozzles 106 and the proximal surface 108 of the flame holder 102. The intermediate flame support surface 118 also substantially defines a proximal end of the premixing region $R_1$. The proximal side 108 of the flame holder 102 can substantially define a distal end of the premixing region $R_1$.

In the embodiment shown, in which a plurality of fuel nozzles 106 are provided, the plurality of fuel nozzles 106 includes a plurality of primary fuel nozzles 202 and a corresponding plurality of secondary fuel nozzles 120. The primary fuel nozzles 202 are configured to selectably support a primary flame (or flames) 306. The diverging fuel stream 302 includes secondary fuel streams 303 supported by the secondary fuel nozzles 120. The primary fuel nozzles 202 and the secondary fuel nozzles 120 are separated by the burner tile 116. The primary flames 306 preferably have a trajectory selected to ignite the secondary fuel streams 303 at or near the intermediate flame support surface 118 of the burner tile 116.

Premixing of the secondary fuel streams 303 in the premixing region $R_1$ can be viewed as being associated with the formation of vortices 308, in the premixing region $R_1$. The vortices 308 cause entrainment of air or flue gas into the cores of the vortices, which can be viewed as well-stirred tank reactors (see FIG. 3B).

If the vortices 308 receive sufficient thermal energy from the primary flames 306, then the resultant heating of the vortex cores (if mixing is provided at a Damkohler Number (Da) greater than or equal to 1) will also cause ignition of the secondary fuel streams 303, as shown in FIG. 3A. The action of the vortices 308 then recirculates the heat to cause the resultant secondary flame 304 to be held by the intermediate flame support surface 118 of the burner tile 116. Under these conditions, holding the flame 304 at the intermediate flame support surface 118 substantially stops premixing in the region $R_1$ because the ignition causes the combustion reaction to occur at the edges of the vortices 308, creating a barrier that prevents air from reaching unburnt fuel inside the flame front. Accordingly, supporting the secondary flame 304 at the intermediate flame support surface 118 can be viewed as significantly reducing or preventing premixing of the secondary fuel streams 303 with air or flue gas.

If the vortices 308 do not receive heat from the primary flames 306, then there can be substantially no ignition of the secondary fuel streams 303. This can be viewed as a prevention of heat recirculation to the intermediate flame support surface 118 of the burner tile 116. This was found by the inventors to cause the secondary flame 304 to be held by the flame holder 102 above the premixing region $R_1$, as shown in FIG. 3B. In the case where the vortices 308 do not receive heat from the primary flames 306, then there can be substantially no flame front at the edges of the vortices 308. In particular, if heat from the primary flames 306 is withdrawn from the vortices 308, either by being redirected or shut down, the secondary flame 304 alone cannot produce sufficient heat to sustain combustion at the intermediate flame support surface 118, and goes out or rises into the flame holder 102, which eliminates the flame front that had acted to isolate the fuel. Having no flame front at the edges of the vortices 308 typically allows dilution of the fuel mixture in the vortex cores, which causes ignition that occurs later at the flame holder 102 to operate under leaner burning conditions.

While the premixing region $R_1$ is described as extending from the intermediate flame support surface 118 and the proximal surface 108 of the flame holder 102, it will be understood that this is an approximation made for ease of understanding. The inventors have found that the secondary flame 304 can occasionally and briefly extend downward from the proximal surface 108 of the flame holder 102. Under this instantaneous condition, vortices 308 in the premixing region $R_1$ can be temporarily bounded by a flame front and premixing may temporarily diminish or stop. However, such flame extensions were found to be transient, and on a time-averaged basis the premixing region $R_1$ can still be considered to support premixing of the secondary fuel stream 302 with air or flue gas.

Another effect found by the inventors was a subtle extension of the secondary flame 304 to a flow stagnation region $R_3$ adjacent to the proximal surface 108 of the flame holder 102 (as illustrated in FIG. 3B). The tertiary flame extension to the stagnation region proved to be more-or-less continuous under stable conditions, and therefore the premixing region $R_1$ can be considered to extend from the intermediate flame support surface 118 to the edge of the secondary flame 304 in the stagnation region $R_3$ just below the proximal surface 108 of the flame holder 102.

The inventors found that the extension of the secondary flame 304 into the stagnation region adjacent to the proximal surface 108 of the flame holder 102 may be desirable. The presence of the secondary flame 304 in the stagnation region appeared to be associated with somewhat more stable operation of the burner 100 compared to cases where visible ignition occurred in the elongated apertures 104.

Ignition of the secondary fuel stream 302 by the primary flames 306, as shown in FIG. 3A, can be selected to substantially prevent premixing of the secondary fuel stream 302 with air or flue gas in the premixing region $R_1$.

In other words, premixing of the secondary fuel stream 302 with an oxidizing fluid, such as air or flue gas, in the premixing region $R_1$ is substantially prevented when the secondary fuel ignites near and is held by the intermediate flame support surface 118. The flame front acts to stop mixing of the air or flue gas with the fuel. Accordingly, supporting the secondary flame 304 at the intermediate flame support surface 118 caused a richer fuel to air mixture. A richer burning mixture may be associated with a somewhat more stable flame (notwithstanding additional flame stability caused by the elongated aperture 104 structures of the flame holder 102) but also a hotter burning flame compared to a leaner burning mixture caused by additional premixing of the secondary fuel stream 302 with air or flue gas in the premixing region $R_1$, as shown in FIG. 3B. A hotter flame is associated with higher oxides of nitrogen (NOx) output than a cooler flame.

Selectable attenuation or stopping of the primary flames 306 can be configured to substantially prevent ignition of the secondary fuel stream 302 at or near the intermediate flame support surface 118 of the burner tile 116. The substantial preventing of ignition of the secondary fuel stream 302 at or near the intermediate flame support surface 118 of the burner tile 116 can cause the secondary flame 304 to be supported by the flame holder 102, as will be explained in more detail below.

In the embodiment of FIGS. 1-3B, the primary fuel nozzles 202 and the secondary fuel nozzles 120 are aligned with one another radially, with respect to the burner tile 116.

According to an embodiment, a primary fuel control valve 312 is arranged to control fuel flow from a fuel source 314 to the primary fuel nozzles 202. The primary fuel control valve 312 can include, for example, a manually actuated valve, an electrically actuated valve, a hydraulically actuated valve, or a pneumatically actuated valve. The primary fuel control valve 312 can be configured to control a characteristic of the primary flames 306 independently from a flow rate of fuel in the secondary fuel streams 303.

A primary fuel pressure valve or pressure control fitting 316 is configured to control pressure of fuel flowing to the primary fuel nozzles 202. The primary fuel pressure valve 316 can be configured to control fuel pressure delivered to the primary fuel nozzles 202 independently from fuel pressure delivered to the secondary fuel nozzles 120.

A secondary fuel control valve 318 is arranged to control fuel flow from the fuel source 314 to the secondary fuel nozzles 120. The secondary fuel control valve 318 can include, for example, a manually actuated valve, an electrically actuated valve, a hydraulically actuated valve, or a pneumatically actuated valve. The secondary fuel control valve 318 can be configured to control a characteristic of the secondary flame 304 independently from a flow rate of fuel to the primary fuel nozzles 202.

A secondary fuel pressure valve or pressure control fitting 320 is configured to control pressure of fuel flowing to the secondary fuel nozzles 120. The secondary fuel pressure valve 320 can be configured to control fuel pressure delivered to the secondary fuel nozzles 120 independently from fuel pressure delivered to the primary fuel nozzles 202.

Alternatively or additionally the primary fuel control valve 316, a primary fuel stream or primary flame 306 deflector can be provided, configured to control a trajectory of the primary flames 306. The primary fuel stream or primary flame deflector is configured to control exposure of the secondary fuel stream 302 to heat at or near the intermediate flame support surface 118 of the burner tile 116. According to an embodiment, the burner tile 116 is disposed peripheral to or surrounding a combustion air passage 204 formed in a combustion volume floor, wall, or ceiling 122. The flame holder 102, in the embodiment of FIGS. 1-3B, includes a central opening 124 disposed axially to the combustion air passage 204. The opening 124 in the flame holder 102 can have a diameter of between 0.10 and 1.0 times a diameter of the combustion air passage 204. According to another embodiment, the opening 124 in the flame holder 102 can have a diameter of between 0.4 and 0.8 times the diameter of the combustion air passage 204.

According to various embodiments, the flame holder 102 is between 1 inch and 4 inches in thickness between the proximal 108 and distal 110 sides. For example, the flame holder 102 can be about 2 inches in thickness between the proximal 108 and distal 110 sides.

The proximal side 108 of the flame holder 102 can be positioned, for example, between 3 inches and 24 inches away from the intermediate flame support surface 118 of the burner tile 116. For example, the proximal side 108 of the flame holder 102 can be disposed between 4 inches and 9 inches away from the intermediate flame support surface 118 of the burner tile 116.

According to an embodiment, the plurality of elongated apertures 104 extending through the flame holder 102 are less than about 1.0 inch in transverse dimension orthogonal to axes of the elongated apertures. For example, the plurality of elongated apertures 104 extending through the flame holder 102 can be between 0.25 inch and 0.75 inch in transverse dimension orthogonal to axes of the elongated apertures. In particular examples, the plurality of elongated apertures 104 defined by the flame holder 102 can be between 0.375 inch and 0.50 inch in transverse dimension orthogonal to axes of the elongated apertures 104.

The flame holder 102 is preferably formed from a refractory material such as a material including a high temperature ceramic fiber. For example, the material can be formed from alumina-silica fibers and binders. In experiments performed by the inventors, the flame holder 102 was formed from a Fiberfrax® Duraboard® product available from Unifrax Corporation, having a principal place of business at 2351 Whirlpool Street; Niagara Falls, N.Y. (USA). The flame holder 102 can be formed by cutting a disk of the appropriate diameter from a material that includes a high temperature ceramic fiber, and by drilling the elongated apertures 104 through the disk. According to another embodiment, the flame holder is cast substantially in its final form from a refractory material.

The flame holder 102 is preferably electrically insulating. However, in other embodiments, the flame holder 102 can be electrically conductive.

A flame holder support structure 126 can be configured to support the flame holder 102 in a furnace, boiler, or other combustion volume aligned to receive the secondary fuel stream 302. The flame holder support structure 126 can be configured to support the flame holder 102 substantially completely around the periphery of the flame holder 102. The flame holder support structure 126 can be formed from steel, for example. In some embodiments, the flame holder support structure 126 is formed integrally with the flame holder 102. For example, the flame holder 102 can be formed by casting the flame holder 102 over a portion of the flame holder support structure 126. According to another embodiment, the flame holder 102 and the flame holder support structure 126 are cast together as a monolithic structure. The flame holder support structure 126 can be configured to couple the flame holder 102 to the burner tile 116, as shown in FIGS. 1 and 2, or can be configured to couple the flame holder 102 to some other mounting substrate, such as, for example, the combustion floor 122.

The fuel nozzles 106 are configured to output a gaseous fuel. In experiments, the inventors used natural gas to test performance and evolve the design. Alternatively or additionally, the fuel nozzles 106 can be configured to output an aerosol of a liquid fuel or a powdered solid fuel.

According to an embodiment, the proximal surface 108 of the flame holder 102 is hardened or includes a hard component configured to resist erosion from the diverging fuel stream.

According to some embodiments, the proximal and distal surfaces 108, 110 are substantially planar. The distal surface 110 and proximal surface can be non-parallel. For example, a thickness of the flame holder 102 can be varied to correspond to an optimal length of the elongated apertures 104, dependent upon fuel flow and lateral divergence distance of the fuel flow across the proximal surface.

Alternatively, the distal surface 110 and the proximal surface 108 can be parallel to one another. The distal surface 110 and proximal surface 108 can define a flame holder thickness. According to an embodiment, the flame holder thickness is about 4 inches.

A method of operation of the burner 100 is described hereafter, according to an embodiment. In operation, and in particular, during start up of the burner 100, as depicted in FIG. 3A, the primary valve 316 is opened to permit a flow of fuel from the primary nozzles 202. As fuel flows from the nozzle 202 in a diverging stream 302, an oxidizing fluid such as air is introduced via the combustion air passage 204, a portion of which is entrained by the fuel stream 302. Primary flames 306 are ignited in a known manner. A trajectory of the primary flames 306 is controlled to be directed primarily toward the intermediate flame support surface 118 of the burner tile 116. Once the primary flames 306 are ignited, the secondary valve 320 is opened and secondary fuel streams 303 flow from the secondary nozzles 120.

Because the burner tile 116 separates the secondary nozzles 120 from the primary nozzle 202 and in particular from the combustion air passage 204, there is not sufficient oxidizer to support a flame in the vicinity of the secondary nozzles 120. The secondary fuel streams 303 therefore rise until they clear the intermediate flame support surface 118 of the burner tile 116 and begin to form vortices 308 above the burner tile 116, and to entrain air from the air passage 204. As soon as sufficient air has been entrained into the vortex cores, heat from the primary flame 306 ignites the secondary fuel streams 303, producing a secondary flame 304 that is supported or held by the flame support surface 118 of the burner tile 116. In addition to the heat supplied by the primary flames 306, a portion of the heat generated by the secondary flames 304 is recirculated by the vortices 308, which enables continued combustion at the flame support surface 118. Heat from the secondary flame 304 also preheats the flame holder 102. While the secondary flame 304 is present at the flame support surface 118, its flame front acts as a barrier to prevent air from reaching the remaining fuel, which is substantially enclosed within the secondary flame 304.

Once the flame holder 102 has reached a minimum operating temperature, the primary valve 316 is partially or completely closed, reducing or extinguishing the primary flame 306, as shown in FIG. 3B. Alternatively, the trajectories of the primary flames 306 can be redirected away from the area directly above the flame support surface 118. Deprived of heat from the primary flame 306, the secondary flame 304 cannot maintain ignition, and eventually goes out. As the secondary flame 304 is extinguished, the secondary fuel streams 303 are no longer prevented from additional premixing in the vortex cores. The premixed fuel then reaches the flame holder 102, which, having been preheated by the secondary flame 304 is sufficiently hot to cause auto-ignition of the premixed fuel, producing a secondary flame 304 held by the flame holder 102. The secondary flame 304 is self-sustaining for as long as sufficient fuel and oxidizer are provided. Because of the action of the vortices 308 in the premix region $R_1$, the fuel of the secondary fuel streams 303 is significantly diluted by entrained air, resulting in a lean fuel mixture.

The flame holder 102 can be configured to be aligned with a diverging fuel stream from a single fuel nozzle. For example, the embodiments of FIGS. 6, 8, and 10, described below, illustrate embodiments configured to be aligned with a single fuel nozzle. Alternatively, the flame holder 102 can be configured to be aligned with diverging fuel streams from a plurality of fuel nozzles. For example, the embodiments of FIGS. 1-4, 5, 7, and 9 illustrate embodiments formed to be aligned with a plurality of fuel nozzles.

The perforated flame holder can be formed as an overall toric shape having a central opening 124 and an outer rim 402. The plurality of elongated apertures 104 can be positioned or arranged in a plurality of coaxial circles as shown, for example, in FIGS. 1, 2, 4, 6, 8, and 10. The plurality of elongated apertures 104 can be formed to be substantially identical in diameter to one another, as in FIGS. 1-3B. Alternatively, the plurality of elongated apertures 104 can be formed to have a plurality of diameters, as shown in FIG. 4.

Figure 4:
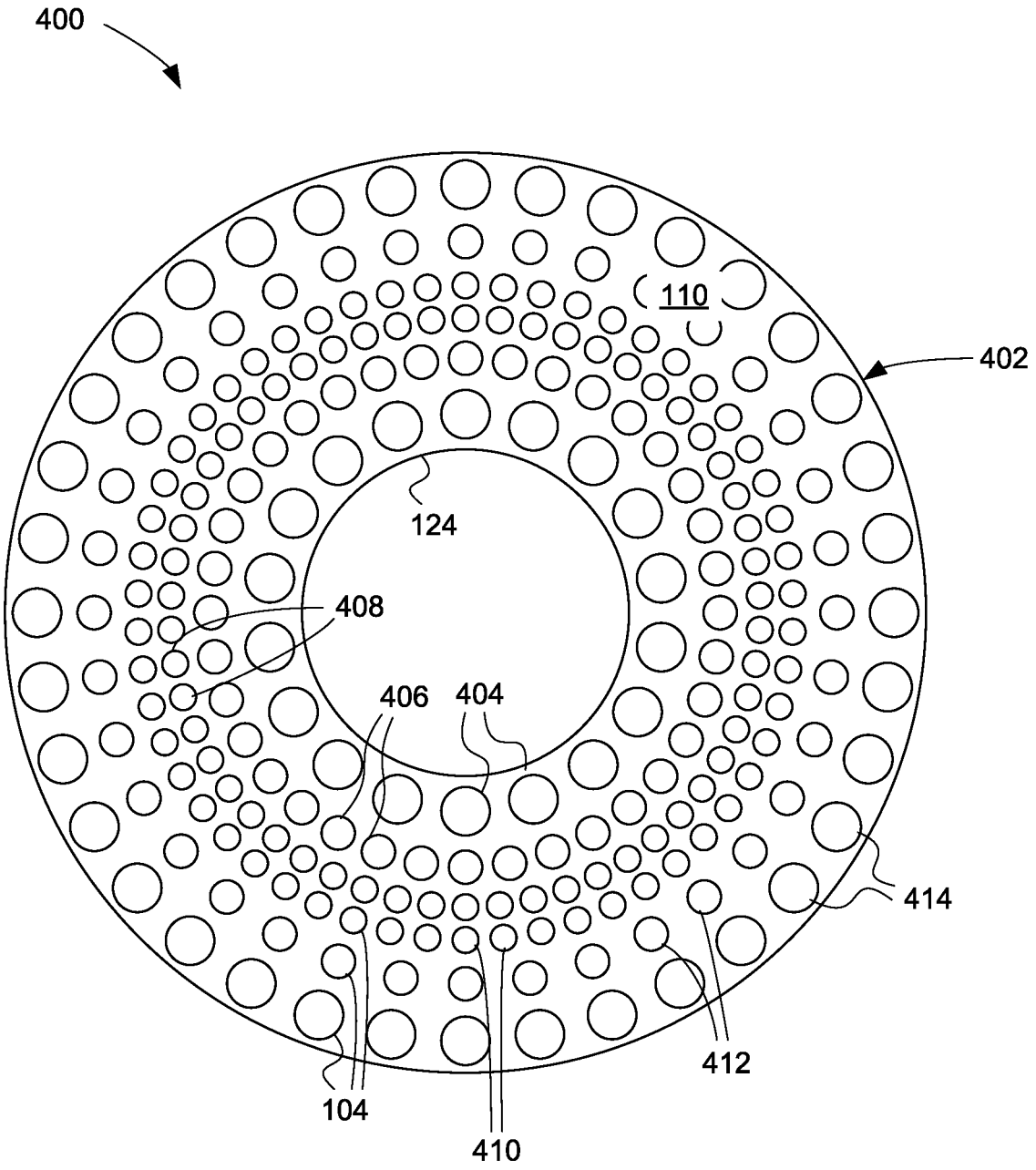
FIGS. 4-10 are plan views of flame holders, according to respective embodiments.

FIG. 4 is a view of a distal surface 110 of a perforated flame holder 400, according to an embodiment. The plurality of elongated apertures 104 are positioned in a plurality of coaxial circles 404, 406 408, 410, 412, 414 with each of the plurality of coaxial circles having elongated apertures 104 of a respective single diameter. For example, according to an embodiment, the diameters of the elongated apertures 104 in each of the coaxial circles 404, 406 408, 410, 412, 414 are between 0.375 inches and 1 inch.

In the embodiment of FIG. 4, for example, the elongated apertures 104 in the innermost circle 404 and the outermost circle 414 have diameters of 1.0 inch, elongated apertures 104 in the two middle circles 408, 410 have diameters of 0.375, and elongated apertures 104 in the two intermediate circles 406, 412 have diameters of 0.5 inch.

Figure 5:
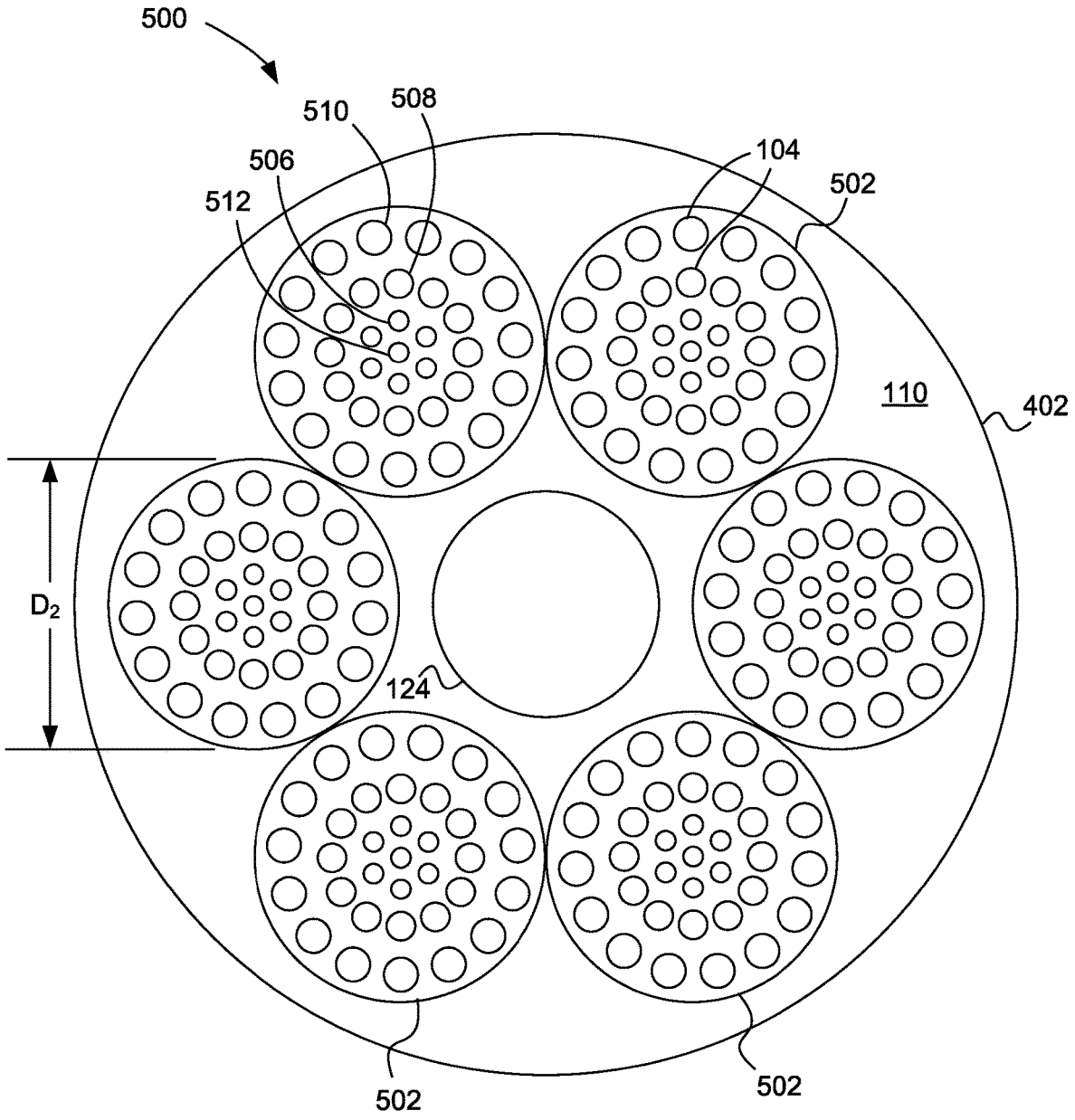

FIG. 5 is a view of a distal surface 110 of a perforated flame holder 500, according to an embodiment. The perforated flame holder 500 is formed in a toric shape having an outer rim 402 and a central opening 124, and is configured to be aligned with a plurality of diverging fuel streams from a plurality of nozzles of a burner assembly. The plurality of elongated apertures 104 are arranged in a plurality of aperture patterns 502. Each aperture pattern 502 is configured to align with a corresponding one of the diverging fuel streams and has a diameter $D_2$ selected to correspond to an approximate diameter of a respective one of the plurality of diverging fuel streams. Each aperture pattern 502 includes a pattern of elongated apertures 104 having a plurality of diameters. In the embodiment shown, each aperture pattern 502 includes a plurality of elongated apertures positioned in concentric circles 506, 508, 510.

The concentric circles 506, 508, 510 are positioned around a central aperture 512, as shown. According to an embodiment, the elongated apertures 104 arranged in the concentric circles 506, 508, 510 are, respectively, 0.375 inch, 0.5 inch, and 0.75 inches in diameter.

Placing the elongated apertures in aperture patterns 502 serves to maximize mechanical robustness of the flame holder 500 in areas where the elongated apertures 104 are not needed to support a combustion reaction. This approach is believed to be advantageous.

Moreover, in experiments conducted by the inventors using a half-scale experimental burner with flame holders in configurations similar to those of many of the embodiments disclosed herein, the smaller size of the largest apertures 104, i.e., those of the concentric circles 506, 508, 510 described with reference to FIG. 5, compared to the largest apertures 104 described with reference to FIG. 4, was believed to result in less unburned fuel and was believed to be advantageous. The inventors believe the optimum elongated aperture size can be representative of larger scale burners owing to relatively consistent fluid dynamics that do not change very much with scale.

The inventors also tested flame holder geometries where a single flame holder would be aligned with a single or each of a plurality of fuel nozzles and corresponding fuel streams.

Figure 6:
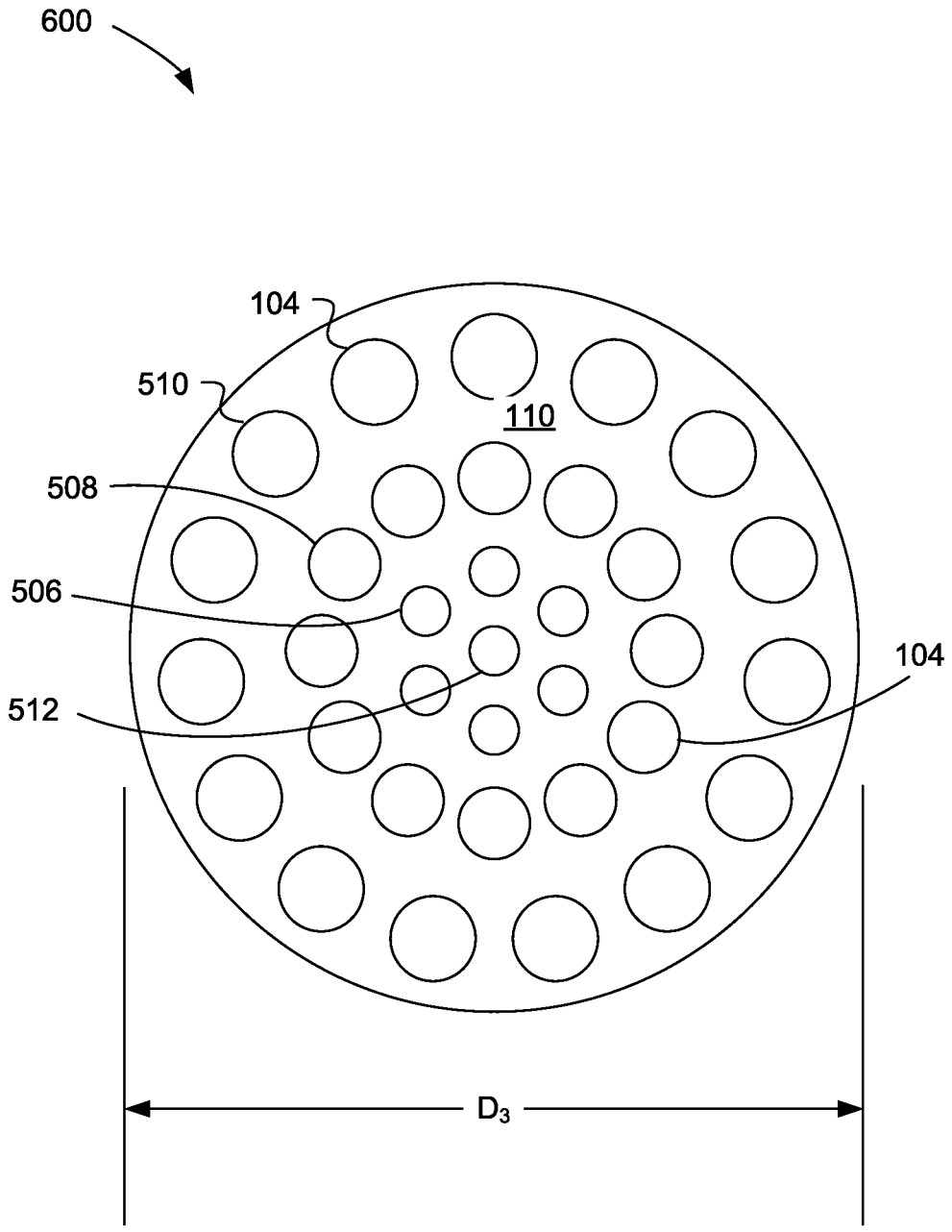

FIG. 6 is a view of a distal surface 110 of a flame holder 600 having elongated apertures 104, according to another embodiment. The flame holder 600 is formed as a disk having a diameter $D_3$ that is selected for alignment with a diverging fuel stream from a single fuel nozzle. The plurality of elongated apertures 104 can be arranged in an aperture pattern. The aperture pattern can include a pattern of elongated apertures having a plurality of diameters or a same diameter. As shown in FIG. 6, the aperture pattern includes a plurality of elongated apertures positioned in concentric circles 506, 508, 510. In an embodiment, the elongated apertures formed in the concentric circles 506, 508, 510 are, respectively, 0.375 inch, 0.5 inch, and 0.75 inches in diameter.

As indicated above, in experiments conducted with a perforated flame holder similar to the flame holder 600 of FIG. 6, it was found that reducing the maximum size of the elongated apertures reduced the amount of unburned fuel. Accordingly, the inventors evolved the designs further to arrive at the patterns illustrated in FIGS. 7 and 8.

Figure 7:
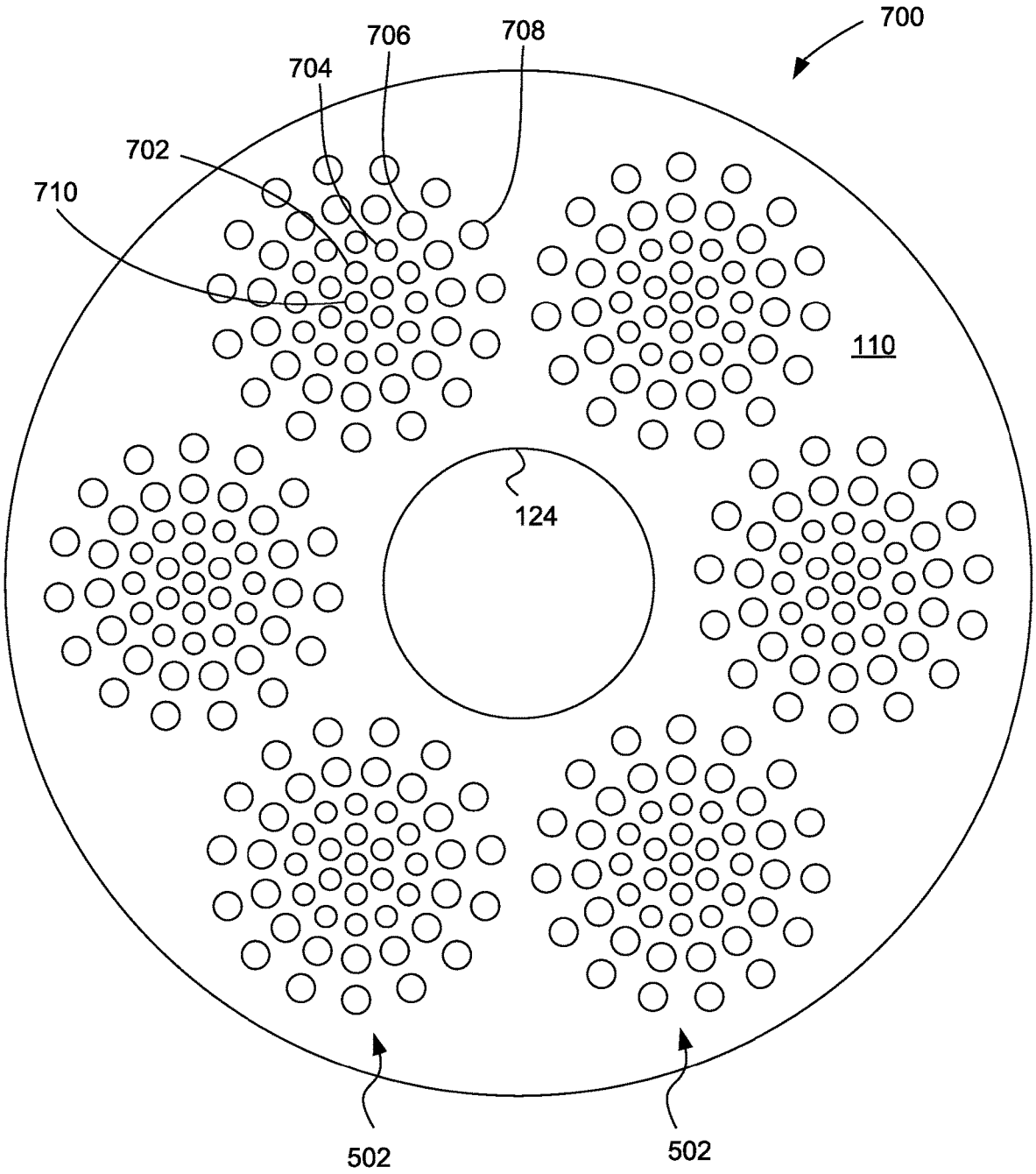
Figure 8:
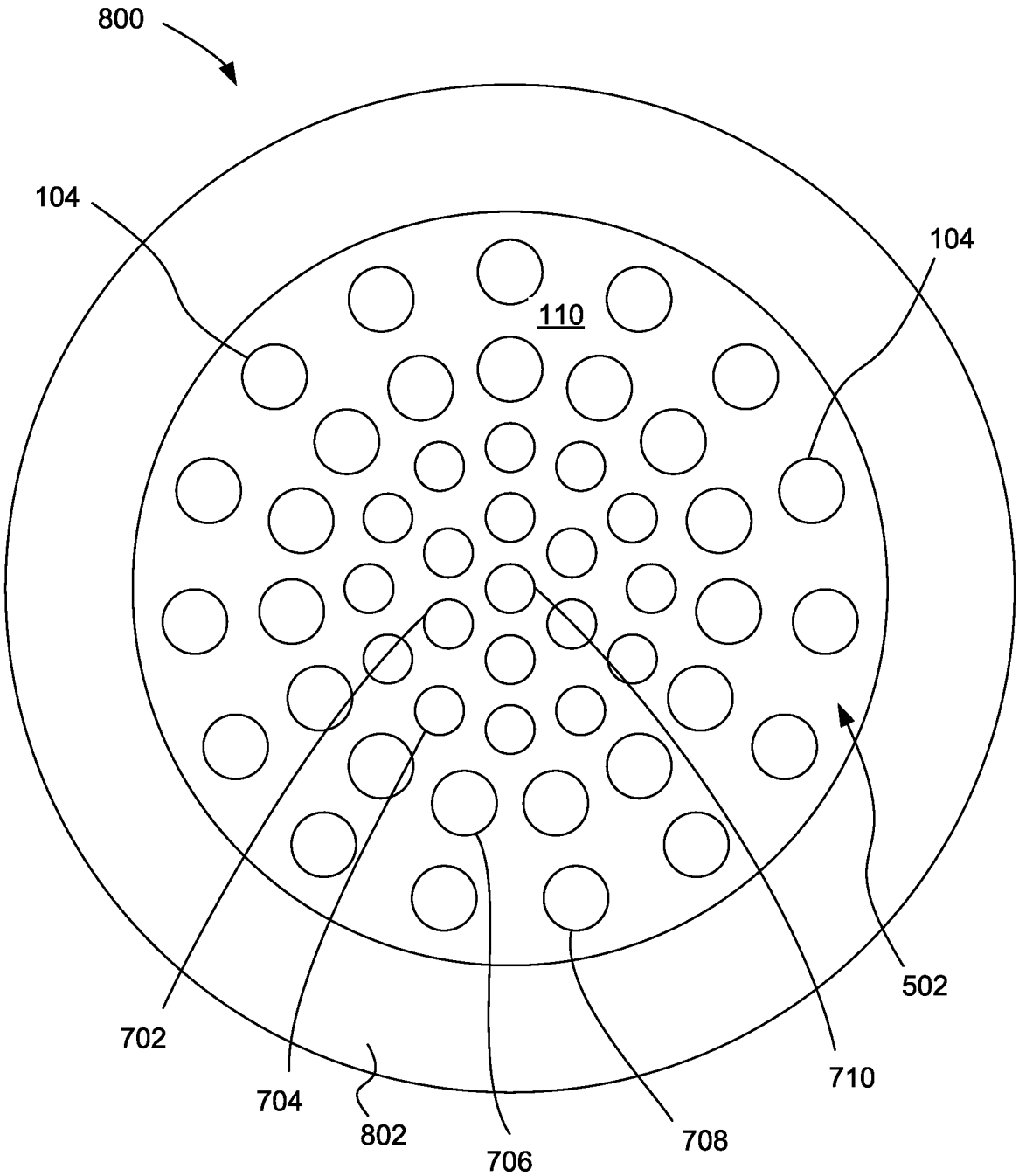

FIG. 7 is a view of a distal surface 110 of a flame holder 700 having orifices 104, according to an embodiment. FIG. 8 is a view of a distal surface 110 of a flame holder 800 having elongated apertures 104, according to a further embodiment. In the embodiments shown in FIGS. 7 and 8, each of the elongated aperture patterns 502 includes apertures each having one of two diameters. Apertures 702, 704 and 710 have diameters of 0.375 inch, while apertures 706, 708 have diameters of 0.5 inch. It is believed by the inventors that changing aperture diameter in a way that increases from the middle toward the outside of a diverging fuel stream can provide a greater turn-down ratio for the burner, i.e., the ratio of the maximum heat output capacity of the burner relative to the minimum required to maintain ignition of the secondary flame 304. In experiments, observation of tertiary flames held by flame holders having the aperture patterns corresponding to the embodiments of FIGS. 7 and 8 led at least some of the inventors to conclude that the smaller maximum aperture size (compared to the embodiments of FIGS. 5 and 6) resulted in a more stable flame and/or less unburned fuel.)

Figure 9:
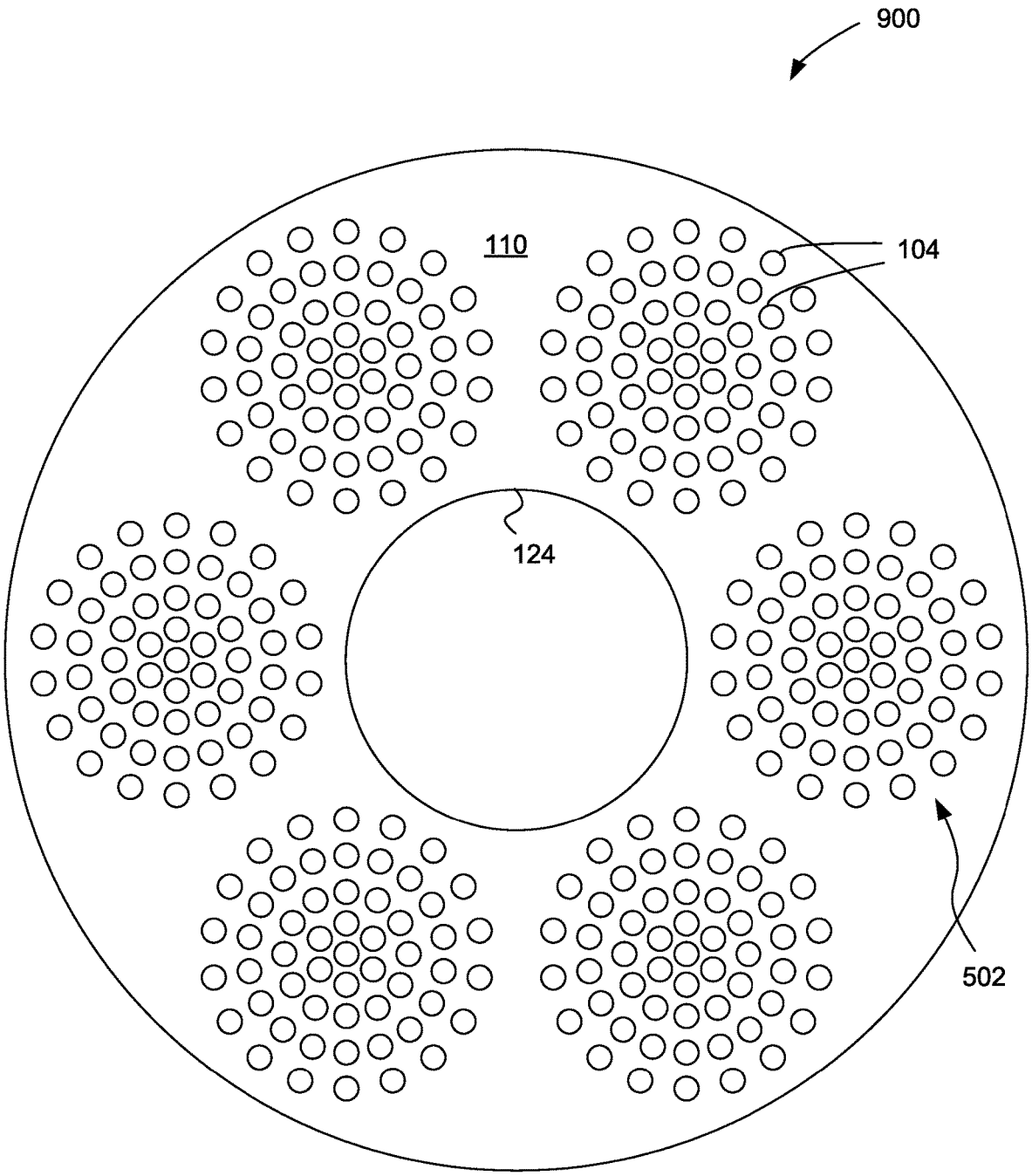
Figure 10:
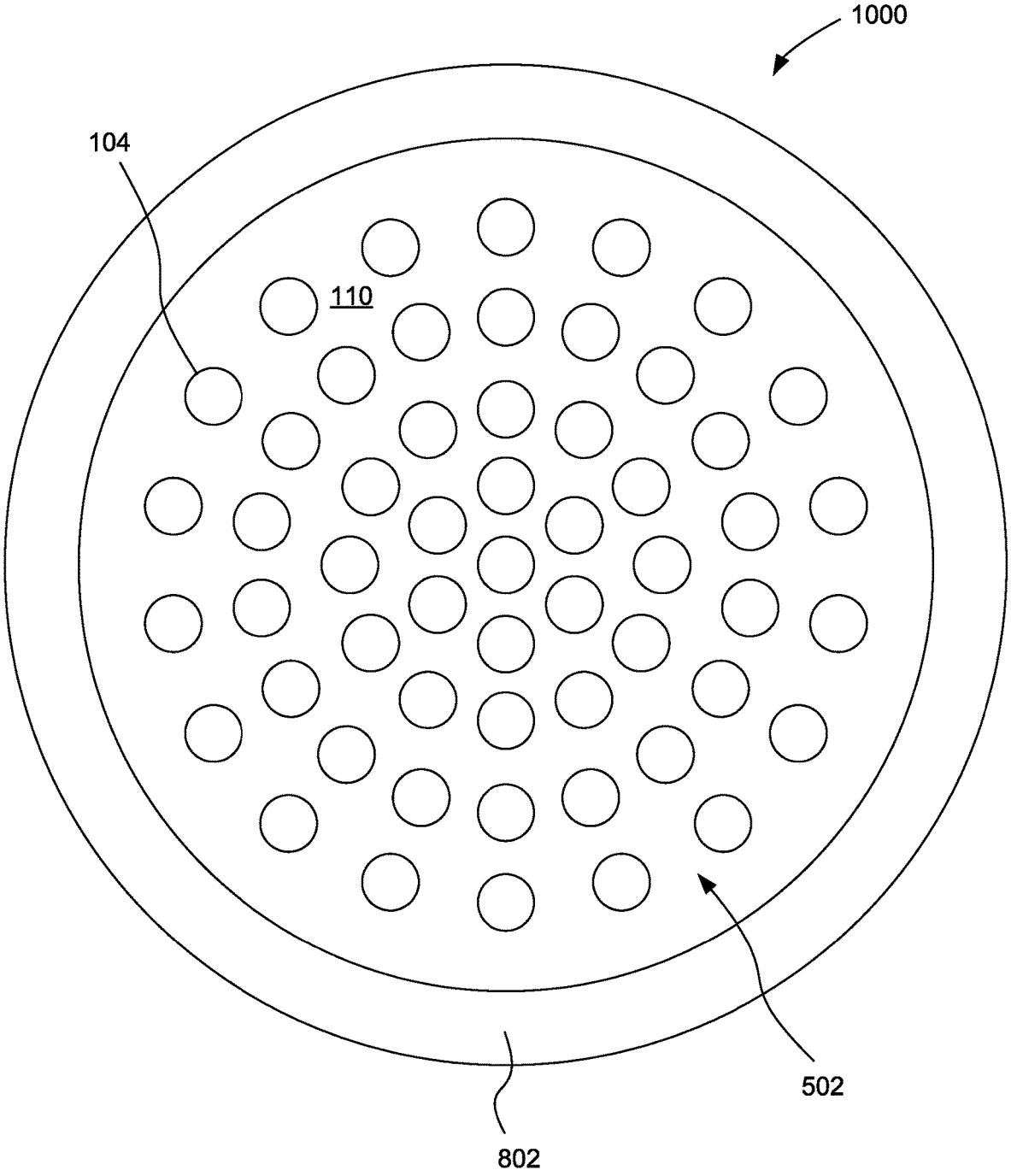

FIG. 9 is a view of a distal surface 110 of a flame holder 900 having orifices 104, according to an embodiment. FIG. 10 is a view of a distal surface 110 of a flame holder 1000 having elongated apertures 104, according to an embodiment. FIGS. 9 and 10 illustrate embodiments in which the elongated apertures 104 in each pattern 502 are of a single diameter of 0.375 inch.

In the embodiments shown in FIGS. 8 and 10 above, the flame holder includes a rim 802 of solid material around the hole patterns 502. The rim 802 of solid material serves to increase mechanical robustness of the respective flame holder. Rim widths can vary, and, according to an embodiment, can range from about 0.5 inch up to about 2 inches. Additionally, it has been found that mechanical robustness is further enhanced by supporting the perforated flame holder around substantially the entirety of its periphery. Accordingly, in some embodiments the flame holder support structure 126 includes a support rim, made from steel or some other material having sufficient heat tolerance and toughness, that supports the flame holder around its entire periphery.

Figure 11:
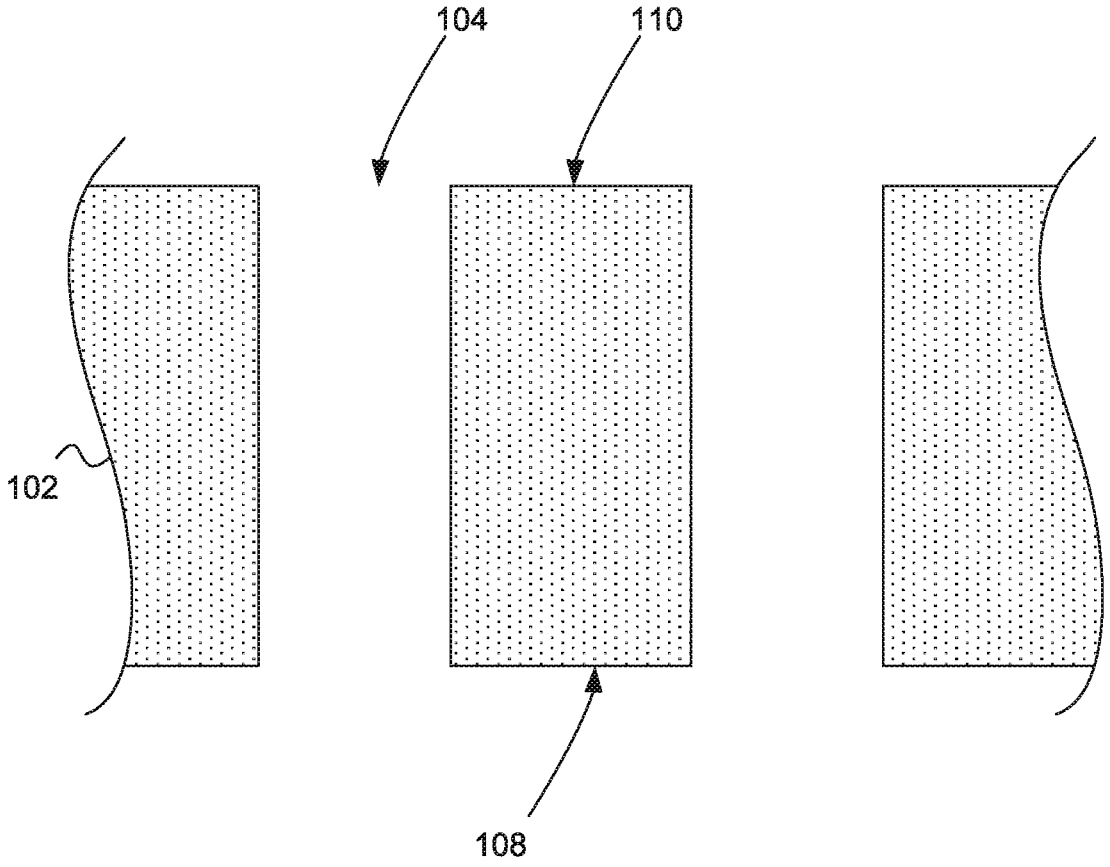
FIGS. 11-14 are sectional views showing details of elongated apertures of flame holders, according to respective embodiments.

FIG. 11 is a longitudinal sectional view of a perforated flame holder 102 having elongated apertures 104, according to an embodiment. The plurality of elongated apertures 104 defined by the flame holder 102 are cylindrical in shape. In other words, as viewed in a transverse cross section, the elongated apertures 104 of FIG. 11 are circular along their entire lengths or a portion thereof. Alternatively, the elongated apertures 104 can have any shape that is appropriate, according to the requirements of a particular embodiment. For example, as viewed in a transverse cross section, the elongated apertures 104 can be square, hexagonal, etc.

Figure 12:
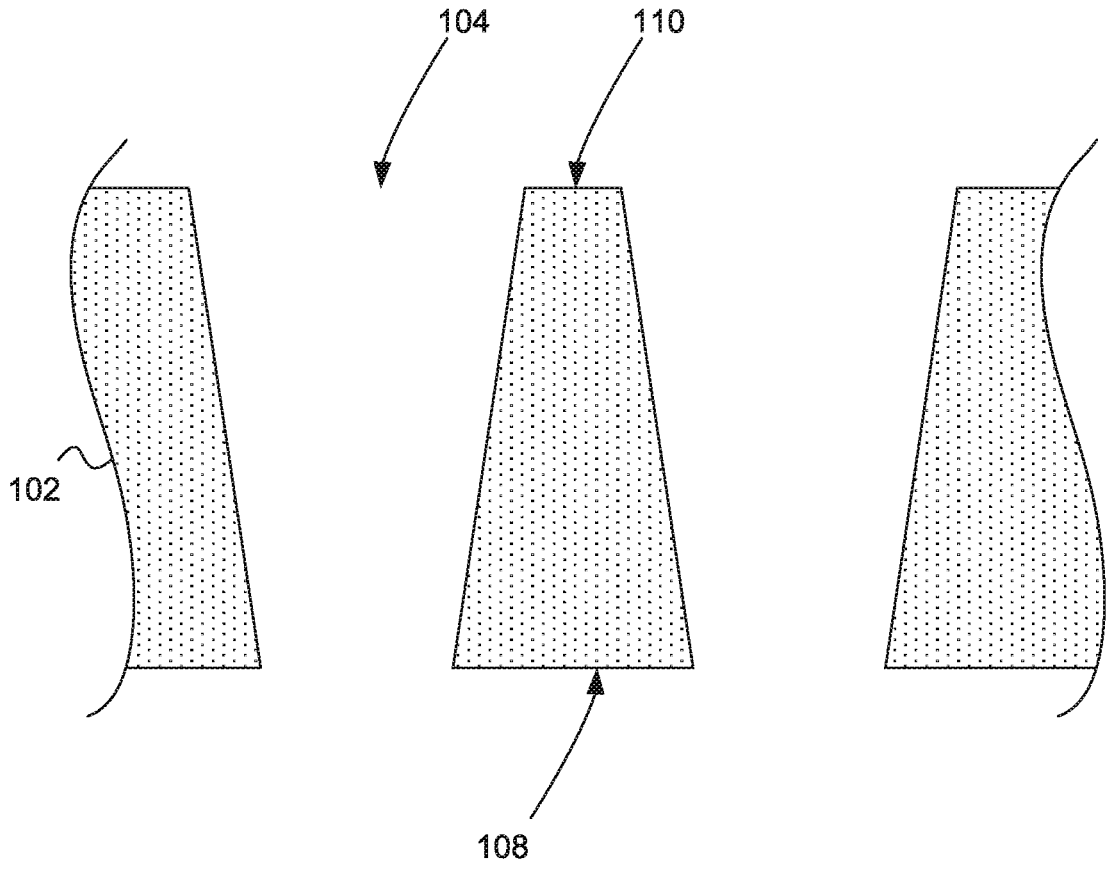
Figure 13:
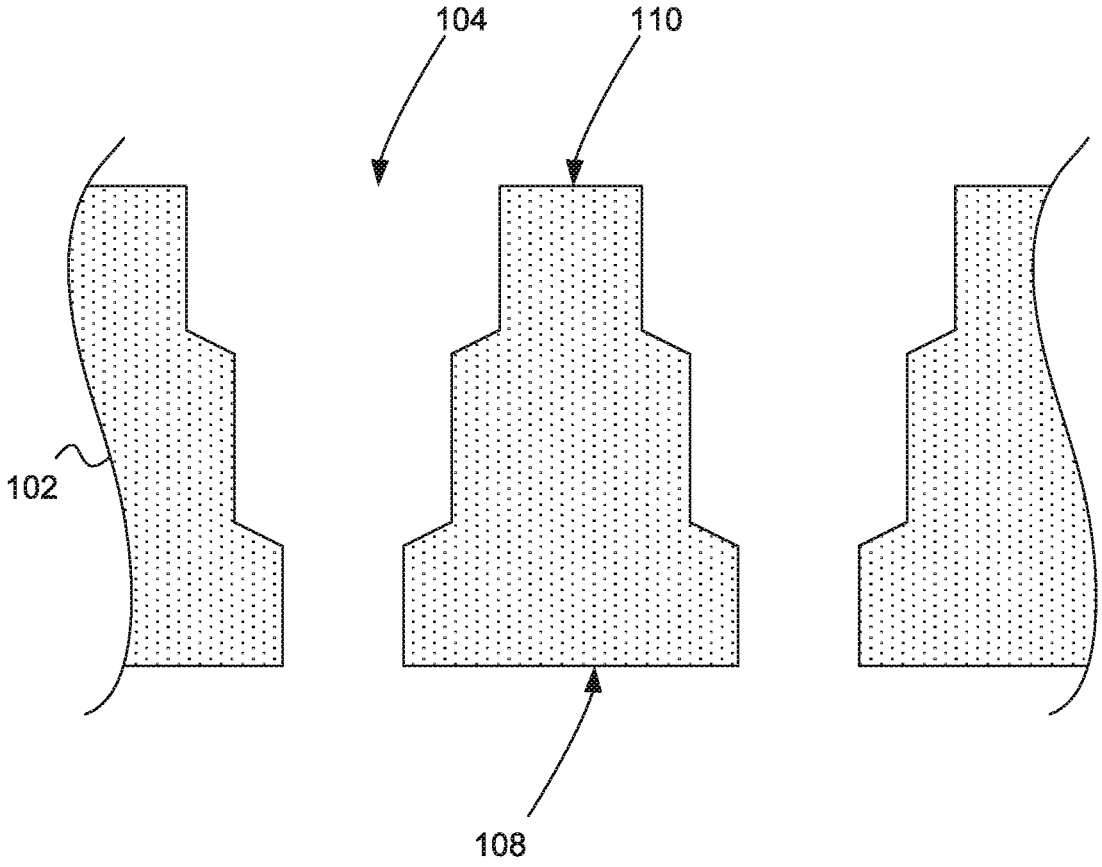
Figure 14:
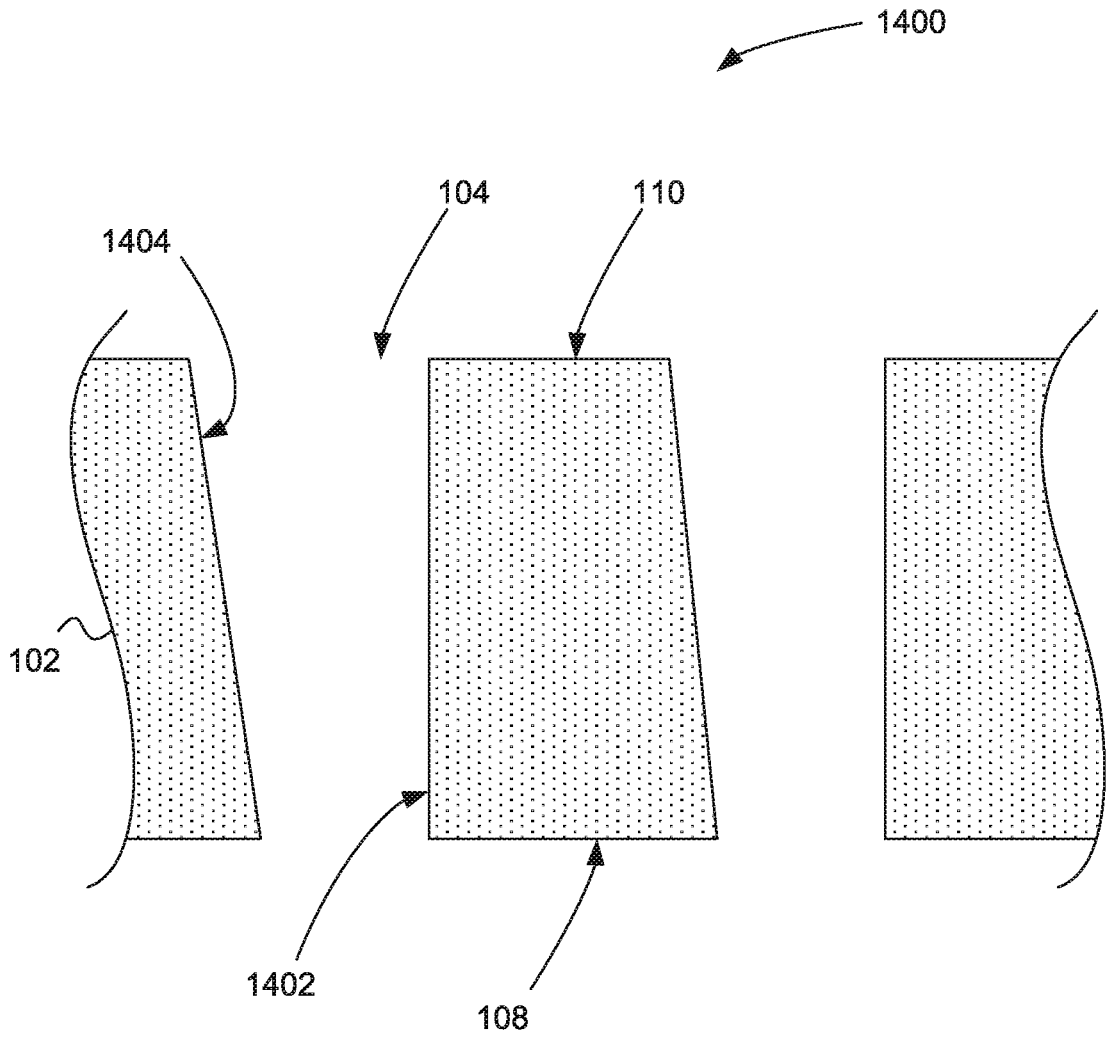

FIG. 12 is a longitudinal sectional view of a perforated flame holder 102 having orifices 104, according to another embodiment. The plurality of elongated apertures 104 defined by the flame holder 102 of FIG. 12 are in the shape of tapered cylinders, i.e., are frusto-conical or frusto-pyramidal in shape. FIG. 13 is a longitudinal sectional view of a perforated flame holder 102 having orifices 104, according to an embodiment. The plurality of elongated apertures 104 defined by the flame holder 102 of FIG. 13 are in the shape of stepped and tapered cylinders. FIG. 14 is a longitudinal sectional view of a perforated flame holder 102 having orifices 104, according to a further embodiment. In FIG. 14, the plurality of elongated apertures 104 defined by the flame holder 102 include vertical portions 1402 and tapered or stepped and tapered portions 1404.

The shape of the elongated aperture 104 can affect the optimum thickness of the flame holder 102, the flame holding characteristics of the flame holder, the combustion efficiency realized with the flame holder, and/or the mechanical and thermal robustness of the flame holder. A cylindrical elongated aperture may be the most simple to make. For example, the taper can be particularly advantageous in economical manufacturing processes, inasmuch as it can provide for the relief required in a casting operation to permit the removal of a cast part from a mold. Additionally, a tapered elongated aperture (more specifically, an elongated aperture that increases in area from the proximal side to the distal side of the flame holder) can allow for thermal expansion without causing "sonic choke" within the elongated aperture. A tapered elongated aperture may operate in a manner akin to a ramjet, where thermal expansion through the elongated aperture produces "thrust" that enhances flow. A stepped and tapered elongated aperture may additionally provided enhanced flame holding owing to vortices formed adjacent to the step(s). A flame holder including a vertical portion and a tapered or stepped and tapered portion may enhance flame holding owing to enhanced vortex formation adjacent to the distal surface of the flame holder proximate to the vertical edge.

An optimal shape of the flame holder, the elongated aperture pattern shape, the thickness of the flame holder, and/or the elongated aperture sectional shape can vary with burner design parameters. For example, a fuel that undergoes combustion with a reduction in moles of products compared to reactants reduce an amount of area increase in a cross sectional shape optimized for thermal expansion. For example, longer chain hydrocarbons have relatively fewer hydrogen atoms and produce less water vapor than methane and other shorter chain hydrocarbons. Similarly, a fuel that is introduced as a powdered solid or as an aerosol has reactants that occupy less volume than a gaseous fuel. A phase change between reactants and products can increase an optimum taper angle of elongated apertures, decrease optimal flame holder thickness, change optimal elongated aperture size, and/or change optimal elongated aperture pattern.

In tests conducted by the inventors, using natural gas, significant improvements in reduction of oxides of nitrogen (NOx) were achieved. In an experiment using a flame holder having the elongated aperture pattern shown in FIG. 8, at a premix region height of 13.5 inches (about 192 secondary nozzle diameters), the tertiary flame appeared unsteady at start-up, but became steady after the furnace warmed up. After warm-up, NOx was reduced by 50% to 65% compared to a secondary flame held at the intermediate flame holding surface shown in FIGS. 1-3B. Throughout testing, carbon dioxide (CO2) concentration was held constant at about 10%. No carbon monoxide (CO) was detected. Heat release from the flame held constant between flame holding locations. In the scale model, the heat release was 130,000 to 140,000 BTU/hour.)

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A burner, comprising:

a fuel nozzle configured to output a fuel stream, wherein the fuel nozzle is one of a plurality of fuel nozzles, incuding a primary fuel nozzle and a secondary fuel nozzle;

a flame holder disposed away from the fuel nozzle and having a proximal side and a distal side disposed toward and away from the fuel nozzle, respectively, the flame holder further having a plurality of elongated apertures extending through the flame holder from the proximal side of the flame holder to the distal side of the flame holder, the flame holder being configured to support a flame in the plurality of elongated apertures between the proximal side and the distal side of the flame holder;

a burner tile positioned adjacent to the fuel nozzle and occupying a portion of a distance between the fuel nozzle and the proximal side of the flame holder; and a primary fuel control valve configured to control fuel flow from a fuel source to the primary fuel nozzle, and a secondary fuel control valve configured to control fuel flow from the fuel source to the secondary fuel nozzle;

wherein the distance between the fuel nozzle and the proximal side of the flame holder is selected to be sufficient for premixing of the fuel stream outputted by the fuel nozzle and an oxidizer entrained by the fuel stream.

2. The burner of claim 1, wherein the burner tile defines an intermediate flame support surface disposed along a diverging fuel stream and configured to support the flame during at least one of a start-up, a low fuel flow, or an ignition by a primary flame.

3. The burner of claim 2, wherein the proximal side of the flame holder is positioned between 3 inches and 24 inches away from the intermediate flame support surface of the burner tile.

4. The burner of claim 3, wherein the proximal side of the flame holder is positioned between 4 inches and 16 inches away from the intermediate flame support surface of the burner tile.

5. The burner of claim 2, wherein the primary fuel nozzle is configured to selectably support the primary flame;

wherein the secondary fuel nozzle is configured to output a secondary fuel stream;

wherein the burner tile is positioned between the primary fuel nozzle and the secondary fuel nozzle; and wherein the primary fuel nozzle is configured to support the primary flame at a trajectory selected to ignite the secondary fuel stream at or near the intermediate flame support surface of the burner tile.

6. The burner of claim 5, wherein the burner tile is configured such that ignition of the secondary fuel stream by the primary flame substantially prevents premixing of the secondary fuel stream with an oxidizer in a premixing region.

7. The burner of claim 5, wherein the selectable support of the primary flame includes selectable attenuation and/or selectable stopping of the primary flame; and wherein the burner tile is configured such that, in the absence of sufficient heat from the primary flame, ignition of the secondary fuel stream at or near the intermediate flame support surface of the burner tile cannot be maintained.

8. The burner of claim 7, wherein the flame holder is configured such that, once initiated, a flame supported by the flame holder maintains ignition while a sufficient mixture of fuel and oxidizer are provided.

9. The burner of claim 5, wherein the primary fuel nozzle is configured to support the primary flame at a trajectory that is selectable between the trajectory selected to ignite the secondary fuel stream at or near the intermediate flame support surface of the burner tile and a trajectory selected to not ignite the secondary fuel stream at or near the intermediate flame support surface of the burner tile.

10. The burner of claim 1, wherein the primary fuel control valve is configured to control the fuel flow from the fuel source to the primary fuel nozzle independently from a flow rate of fuel controlled by the secondary fuel control valve.

11. The burner of claim 1, further comprising a primary fuel pressure control element configured to control pressure of fuel flowing to the primary fuel nozzle.

12. The burner of claim 11, wherein the primary fuel pressure control element configured to control the pressure of fuel flowing to the primary fuel nozzle controls independently from a secondary fuel pressure delivered to the secondary fuel nozzle.

13. The burner of claim 1, further comprising:

a primary deflector configured to control a trajectory of a primary flame supported by the primary fuel nozzle.

14. The burner of claim 13, wherein the primary deflector is configured to control exposure of a secondary fuel stream to heat from the primary flame.

15. The burner of claim 1, wherein the burner tile is disposed adjacent to a combustion air passage configured to provide a fluid including an oxidizer.

16. The burner of claim 15, wherein the flame holder includes an additional aperture disposed axially to the combustion air passage.

17. The burner of claim 16, wherein the additional aperture in the flame holder has a diameter of between 0.10 and 1.0 times a diameter of the combustion air passage.

18. The burner of claim 17, wherein the additional aperture in the flame holder has a diameter of between 0.4 and 0.8 times the diameter of the combustion air passage.

19. The burner of claim 1, wherein the flame holder is between 1 inch and 6 inches in thickness between the proximal and the distal sides.

20. The burner of claim 19, wherein the flame holder is about 4 inches in thickness between the proximal and the distal sides.

21. The burner of claim 1, wherein the plurality of elongated apertures are less than about 1.0 inch in transverse dimension orthogonal to axes of the elongated apertures.

22. The burner of claim 21, wherein the plurality of elongated apertures are between 0.25 inch and 0.75 inch in transverse dimension orthogonal to the axes of the elongated apertures.

23. The burner of claim 22, wherein the plurality of elongated apertures are between 0.375 inch and 0.50 inch in transverse dimension orthogonal to the axes of the elongated apertures.

24. The burner of claim 21, wherein the flame holder is about 4 inches in thickness between the proximal and the distal sides.

25. The burner of claim 1, further comprising: a flame holder support structure configured to support the flame holder in a combustion volume, positioned to receive the fuel stream.

26. The burner of claim 25, wherein the flame holder support structure is formed at least partially integrally with the flame holder.

27. The burner of claim 26, wherein the flame holder is formed by casting a high temperature material over a portion of the flame holder support structure.

28. The burner of claim 1, wherein the proximal side of the flame holder includes a hard component configured to resist erosion from the fuel stream.

29. A perforated flame holder for a combustion reaction, comprising:

a disk-shaped element formed from a high-temperature-compatible material having a distal surface and a proximal surface, and including a plurality of elongated apertures extending through the disk-shaped element from the proximal surface to the distal surface, the disk-shaped element having an X:Y aspect ratio of at least 4:1;

wherein the distal surface includes a substantially planar distal surface;

wherein the proximal surface includes a substantially planar proximal surface; and wherein the substantially planar distal surface and the substantially planar proximal surface are parallel to one another.

30. The perforated flame holder for a combustion reaction of claim 29, further comprising:

a flame holder support structure configured to couple the disk-shaped element to a mounting substrate, and to maintain a selected distance between the proximal surface of the disk-shaped element and the mounting substrate.

31. The perforated flame holder for a combustion reaction of claim 29, wherein the distal surface and the proximal surface define a flame holder thickness.

32. The perforated flame holder for a combustion reaction of claim 31, wherein the flame holder thickness is about 4 inches.

33. The perforated flame holder for a combustion reaction of claim 29, wherein the disk-shaped element has an overall toric shape having a central opening and a substantially circular outer rim that is coaxial with the central opening.

34. The perforated flame holder for a combustion reaction of claim 33, wherein each of the plurality of elongated apertures is positioned in one of a plurality of aperture patterns.

35. The perforated flame holder for a combustion reaction of claim 34, wherein the ones of the plurality of elongated apertures positioned in each respective one of the plurality of aperture patterns includes elongated apertures having a plurality of diameters.

36. The perforated flame holder for a combustion reaction of claim 34, wherein each of the plurality of aperture patterns includes a respective number of the plurality of elongated apertures arranged in concentric circles.

37. The perforated flame holder for a combustion reaction of claim 29, wherein each of the plurality of elongated apertures is positioned in one of a plurality of circles.

38. The perforated flame holder for a combustion reaction of claim 29, wherein each of the plurality of elongated apertures has a substantially identical diameter.

39. The perforated flame holder for a combustion reaction of claim 29, wherein each of the plurality of elongated apertures is positioned in one of a plurality of coaxial circles with the apertures in each of the plurality of coaxial circles having a respective single diameter.

40. The perforated flame holder for a combustion reaction of claim 39, wherein each of the plurality of elongated apertures has a diameter of no more than 1 inch.

41. The perforated flame holder for a combustion reaction of claim 29, wherein each of the plurality of elongated apertures has a cylindrical shape.

42. The perforated flame holder for a combustion reaction of claim 29, wherein each of the plurality of elongated apertures has a frusto-conical shape.

43. The perforated flame holder for a combustion reaction of claim 29, wherein each of the plurality of elongated apertures has a cylindrical shape with a diameter that varies stepwise along a portion of its length.

44. The perforated flame holder for a combustion reaction of claim 29, wherein each of the plurality of elongated apertures has a shape that is cylindrical along a portion of its length and frusto-conical along another portion of its length.

* * * * *